United States Patent [19]

Becker et al.

[11] Patent Number: 4,563,250

[45] Date of Patent: Jan. 7, 1986

[54] METHOD FOR PRODUCING MULTICHANNEL PLATES

[75] Inventors: Erwin Becker; Wolfgang Ehrfeld, both of Karlsruhe, Fed. Rep. of Germany

[73] Assignee: Kernforschungszentrum Karlsruhe GmbH, Karlsruhe, Fed. Rep. of Germany

[21] Appl. No.: 708,841

[22] Filed: Mar. 6, 1985

[30] Foreign Application Priority Data

Mar. 10, 1984 [DE] Fed. Rep. of Germany ..... 3408848

[51] Int. Cl.[4] ..... C25D 1/02; C25D 1/10

[52] U.S. Cl. ..... 204/6; 204/9; 204/11

[58] Field of Search ..... 204/6, 9, 11

[56] References Cited

U.S. PATENT DOCUMENTS 4,422,905 12/1983 Becker et al. ..... 204/9
4,493,753 1/1985 Becker ..... 204/9

FOREIGN PATENT DOCUMENTS 3039110 5/1982 Fed. Rep. of Germany ..... 204/11
2414658 1/1983 Fed. Rep. of Germany ..... 204/11
3150257 6/1983 Fed. Rep. of Germany ..... 204/11

OTHER PUBLICATIONS

Michael Lampton, Spektrum der Wissenschaft [Science Spectrum] Jan. 1982, pp. 44–55.

*Primary Examiner*—T. M. Tufariello
*Attorney, Agent, or Firm*—Spencer & Frank

[57] ABSTRACT

A method for producing a multichannel plate containing a plurality of generally parallel channels for use in structures for amplifying or converting optical images or other two-dimensional signal patterns by secondary electron multiplication, which method includes:

producing a positive mold of the plate, by the steps of: (i) providing a body having the external shape of the plate to be produced and made of a material whose ability to be removed from the body is altered by exposure to a selected radiation; (ii) irradiating the body with the selected radiation in a pattern corresponding to the plate to be produced and in a manner to render the portions of the body corresponding to the channels more easily removable than the remaining portions of the body; and (iii) removing the more easily removable portions of the body;

forming a metal negative mold, by the steps of: (i) attaching the positive mold to a metal electrode; (ii) electrolytically depositing metal on the electrode and in the openings created in the positive mold by said step of removing more easily removable portions; and (iii) removing the positive mold from the deposited metal; and forming the multichannel plate from the negative mold.

6 Claims, 8 Drawing Figures

METHOD FOR PRODUCING MULTICHANNEL PLATES

BACKGROUND OF THE INVENTION

The present invention relates to a method for producing multichannel plates as amplifiers for optical images or other two-dimensional signal patterns by means of secondary electron multiplication and to the use of a stack of multichannel plates produced according to this method.

It is known to amplify optical images or other two-dimensional signal patterns by means of a so-called multichannel image amplifying plate, channel multiplier plate, or microchannel plate. Such a plate is composed of a glass plate approximately 1 mm in thickness which is encased in an evacuated vessel and is penetrated by a plurality of closely adjacent channels, each approximately 30 microns in diameter, extending perpendicularly or obliquely to the major surfaces of the plate. By using lead oxide containing glasses and a subsequent treatment with reducing gases at elevated temperatures, the walls of the channels are made weakly electrically conductive.

The application of a voltage of about 1000 volt between the metal coated surfaces of the plate produces a potential gradient in the channels, thus imparting the characteristics of a secondary electron multiplier to each channel.

If the channels are given an oblique orientation, collision of primary particles with the channel walls, and thus the desirable release of electrons, is enhanced. Additionally, this channel orientation permits assembly of a stack of plates having a zigzag channel structure which suppresses the undesirable acceleration of parasitic ions. A similar effect can be realized by slightly curving the channels.

Several manufacturing methods are known for such multichannel plates: see, for example Michael Lampton, Spektrum der Wissenschaften [Science Spectrum], January 1982, pages 44–55, which is a translation of an article published in Scientific American, November, 1981. The uses of such multichannel plates are also discussed in this publication.

In the so-called metal core process, a fine, uniform wire is covered with heated glass and wound around a polygonal drum. Individual blocks are then cut out of the coil and the glass coatings of the wires are melted together. Thereafter, the block is cut into thin wafers from which the wire cores are removed by etching. A significant drawback of the described metal core process is found in the fact that the metal cores, and thus the channels, although they have uniform diameters, vary considerably in their spacing from one another.

In another manufacturing process, fine parallel grooves are etched photolithographically into the surfaces of thin glass plates. The plates are stacked in such a manner that the grooves of superposed plates together form the desired channels. Then, the plates are melted together to form blocks from which the multichannel plates are then cut. The advantage of this method is that the distances between the grooves can be regulated with precision during the photolithographic etching. Also, in this method, the channels can be made to be relatively slightly curved or given a zigzag shape. However, it has been found that it is hardly possible to monitor width and depth of the grooves during etching and during the melting process. The result is that the multichannel plates distort the images too much during amplification so that the process finally was found to be unusable.

Today, multichannel plates are usually produced according to the so-called double drawing process. Hollow glass cylinders or glass cylinders filled with a more easily soluble glass are drawn into glass filaments which are bundled, melted and drawn further, whereupon the procedures of bundling and melting are repeated. The final bundle is cut into plates of approximately 1 mm thickness, with the cores of the more easily soluble glass, drawn down to a diameter of about 30 microns, being dissolved out. Due to the manufacturing principle involved, certain fluctuations in cross section and position of the channels are unavoidable in this double drawing process as well.

Variations in cross section and position of the channels in such multichannel plates prevent or make more difficult the precise association of other optical and/or electrical components produced by microproduction methods with the individual channels or channel groups of the image amplifier. However, such an association is important, for example, for the separate further electrical processing of electrical currents furnished by the individual channels or groups of channels. The fluctuations in cross section and position of the channels in the prior art multichannel plates are also responsible for the fact that considerable losses in resolution arise when the above-mentioned plate stacks are assembled to have the zigzag channel structure.

DE-OS [Federal Republic of Germany Laid-Open Application] No. 3,150,257 and DE-PS [Federal Republic of Germany Patent] No. 2,414,658 disclose layered multichannel plates for image amplifiers employing dynodes in the form of perforated dynode plates wherein the preferred method for producing the channel system is the photoetching technique. The dynode material, e.g. a BeCu-Le alloy is etched in through illuminated and developed photoresist masks. Good results are obtained with this technique in practice, if the diameters of the channels and the thickness of the dynode are approximately equal (see column 3, lines 5 to 10 of DE-PS No. 2,414,658).

SUMMARY OF THE INVENTION

Taking into account the state of the art, it is an object of the present invention to produce multichannel plates of the above discussed species in which given cross sections and positions for the channels are strictly adhered to and the thickness of the plates can be a multiple of the channel diameters.

The above and other objects are achied, according to the present invention, by a method for producing a multichannel plate containing a plurality of generally parallel channels for use in structures for amplifying or converting optical images or other two-dimensional signal patterns by secondary electron multiplication, which method includes:

(a) producing a positive mold of the plate, by the steps of:
  (i) providing a body having the external shape of the plate to be produced and made of a material whose ability to be removed from the body is altered by exposure to a selected radiation;
  (ii) irradiating the body with the selected radiation in a pattern corresponding to the plate to be produced and in a manner to render the portions of the body corresponding to the channels more easily removable than the remaining portions of the body; and (iii) removing the more easily removable portions of the body;

(b) forming a metal negative mold, by the steps of:

(i) attaching the positive mold to a metal electrode;

(ii) electrolytically depositing metal on the electrode and in the openings created in the positive mold by the step of removing more easily removable portions; and (iii) removing the positive mold from the deposited metal; and (c) forming the multichannel plate from the negative mold.

With the method according to the present invention it is possible to predetermine the cross-sectional configuration and the positions of the individual channels with a tolerance of the order of magnitude of one micron even for relatively thick multichannel plates.

The method according to the invention has the additional advantage that it makes possible achievement of a particularly high ratio of the sum of channel cross-sectional areas to the total surface area of the plate, i.e. the multichannel plates will have particularly high transparency.

The high energy radiation employed may be corpuscular radiation or electromagnetic waves, particularly X-rays generated by an electron synchrotron (synchrotron radiation). While masks are used in the known manner to generate the desired structures by means of electromagnetic waves, the structures may also be produced utilizing electromagnetic control if corpuscular rays are employed.

The material for producing the multichannel positive molds or secondary multichannel positive molds depends on the type of high energy radiation employed, with the respective directions for use being available, for example, in German Pat. No. 2,922,642 and its counterpart U.S. Pat. No. 4,422,905, and DE-OS No. 3,221,981 and its counterpart U.S. application Ser. No. 502,721, Becker et al, now U.S. Pat. No. 4,493,753.

The metallic multichannel negative mold is produced by electrolytic molding of the multichannel positive mold connected with a metal electrode. The metal electrode may here be used as the base plate for the metallic multichannel negative mold. However, it is also possible to continue the electrolytic deposition of metal until the multichannel positive mold is covered by a continuous metal layer which, possibly after having its surface smoothed, is used as the base plate for the metallic multichannel negative mold. With suitable selection of the electrode material, possibly in conjunction with passivation of its surface, it is possible in this case to prevent, in a known manner, adhesion of the deposited material to the electrode. Then it is possible to separate the multichannel positive mold together with the electrode connected thereto from the resulting multichannel negative mold without damage which permits repeated use of the multichannel positive mold.

To fix the positions of the channels in the metallic negative molds, it may be advantageous to connect the free ends of the columnar negative molds by means of metal bridges.

A glass containing lead oxide, as it is used to produce the prior art multichannel plates, can be used to fill the metallic multichannel negative mold. The glass may be melted in or, if glass powder is used, it may be sintered in. However, other electrically nonconductive or weakly conductive materials, for example $Al_2O_3$ powder, can also be used for filling the channels, which can then be sintered together at a higher temperature to form a stable body. In order to realize sufficient electrical conductivity, it may be necessary to replace the post-treatment with $H_2$ as it is customary for lead-oxide containing glasses, with another post-treatment, e.g. according to the known chemical vapor deposition (CVD) method.

To reduce costs for the mass production of multichannel plates of the type defined above, the method according to the present invention may be modified in a manner to be described below. Relevant molding details are disclosed, for example, in German Pat. No. 3,206,820.4 and counterpart U.S. application Ser. No. 470,281 Becker et al., now U.S. Pat. No. 4,541,977. Nonadhesive reaction resins are particularly suitable as molding masses.

To suppress the undesirable acceleration of parasitic ions, multichannel plates produced according to the present invention and provided with oblique channels with respect to the plate surface may also be stacked in such a manner that zigzag channel structures result. While in stacks of prior art multichannel plates losses in spatial resolution had to be accepted due to the unavoidable fluctuations in cross section and position of the channels, stacking of the multichannel plates produced according to the present invention may be effected by mutually aligning the channel openings, thus substantially avoiding this drawback.

The method according to the present invention will now be described in an exemplary manner with reference to the drawings.

DESCRIPTION OF THE PREFERRED EMBODIMENTS

Figure 1:
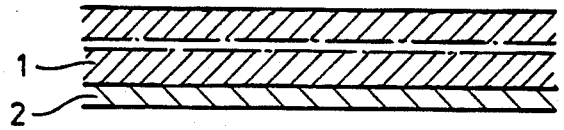
FIGS. 1 through 7 are schematic cross-sectional views illustrating the individual steps in the manufacture of a multichannel plate according to the invention.

Referring to FIG. 1, the starting material for the production of the multichannel positive mold is a plate 1, 0.5 mm thick, of polymethylmethacrylate (PMMA) which is applied to adhere permanently to a metallic base plate 2 of an iron-nickel alloy constituting the electrode.

Figure 2:
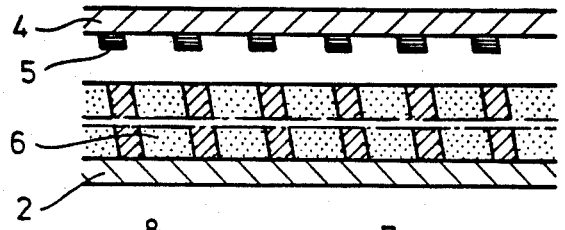

As shown in FIG. 2, PMMA plate 1 is irradiated through an X-ray mask 4,5 with synchrotron radiation 3 which is directed at an angle to the surfaces of the PMMA plate and to the X-ray mask. The X-ray mask is composed of a carrier 4 which only weakly absorbs the X-rays and of a grid-like absorber 5 which greatly absorbs the X-rays and which serves to define the cross-sectional configurations and positions of the channels. The high intensity collimated synchrotron radiation 3 causes the PMMA to be changed with respect to a chemical characteristic in regions 6 which are not aligned with absorber 5.

Figure 3:
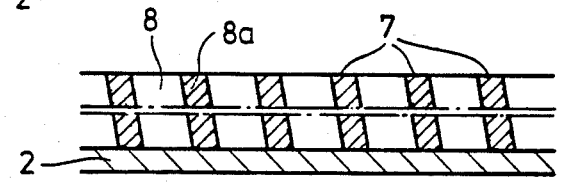

The irradiated regions 6 are removed by placing the PMMA plate 1 into a developer solution so that a multichannel positive mold 7 having channel-shaped penetrations 8 results as shown in FIG. 3. A mixture of a glycol ether, a primary amine and water, as well as a substance from the azine group as defined in DE-OS No.

3,039,110, is preferably used as the developer solution. The channel-like perforations have a hexagonal cross section and a width of about 30 microns; the thickness of walls 8*a* is about 3 microns.

Figure 4:
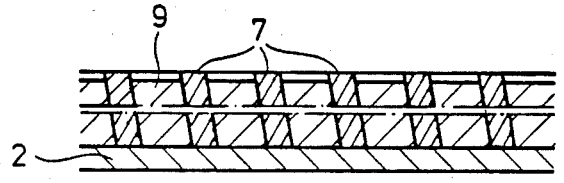

According to FIG. 4, in the next production step, an iron-nickel alloy is electrolytically deposited in the channel-like perforations 8, so that columnar structures 9 of this alloy are formed on the electrically conductive base plate 2 in the grid-shaped multichannel positive mold 7. The multichannel positive mold 7 is then removed by dissolving in a solvent so that a metallic negative mold for the multichannel plate is left as shown in FIG. 5.

Figure 6:
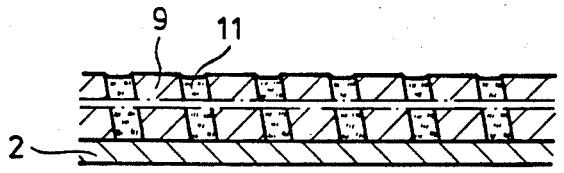

In further processing steps, the interstices 10 between columnar structures 9 of the metallic negative mold are filled under vacuum with a lead glass melt 11 as shown in FIG. 6. Due to the use of the above-mentioned iron-nickel alloy, it can then be assured that the lead glass and the alloy have approximately the same coefficients of thermal expansion so that the stresses occurring during cooling will not lead to the formation of cracks in the glass. The structure composed of glass 11 and metal 9 is then polished to remove plate 2 and smooth the major surfaces of the structure, and the metal 9 is removed by dissolving it in a selective etching bath.

Figure 7:
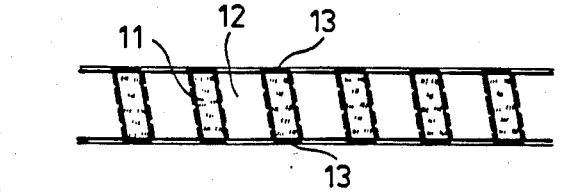

Finally, the multichannel plate provided with perforations 12 is coated in a known manner on both sides by sputtering so that thin conductive layers 13 result, as shown in FIG. 7, while the inner surfaces of the channels are made to be weakly electrically conductive by heating them in hydrogen.

Figure 5:
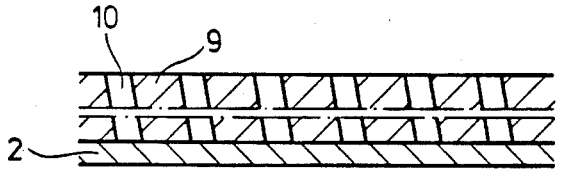

In the practice of a specific preferred embodiment of the invention, the primary metallic negative mold, which corresponds to the mold shown in FIG. 5, is filled with a reaction resin which does not adhere to the metal and serves as a molding mass. This material is filled to beyond the columnar structures of the metallic negative mold. After the reaction resin hardens, it forms a secondary multichannel positive mold from which the primary metallic multichannel negative mold is separated. The mechanical separation of the secondary positive mold from the primary negative mold is carried out by means of a simple pulling-off device consisting of a high-precision slide which is operated by means of a spindle.

Then, the secondary multichannel positive mold is applied to a metallic base plate, which serves as an electrode, with the side of the positive mold at which the openings are exposed facing, and contacting, the base plate. Material is then removed from the closed secondary multichannel positive mold to the extent that the channel openings are exposed. By subsequent electrolytic deposition, a secondary metallic negative mold is produced which again corresponds to that shown in FIG. 5. The further steps in the production of the multichannel plate are then performed on the secondary negative mold as described above in connection with FIGS. 6 and 7.

Each secondary multichannel positive mold produced from a reaction resin mold can likewise be used several times for electrolytic molding. For a better separation of the multiuse secondary multichannel positive mold from the secondary multichannel negative mold, it has been found to be advantageous to apply, before the electrolytic molding process, a thin film of separating agent to the channel walls of the secondary multichannel positive mold. The separating agent film is applied in a known manner by dipping the mold into a separating agent solution.

Figure 8:
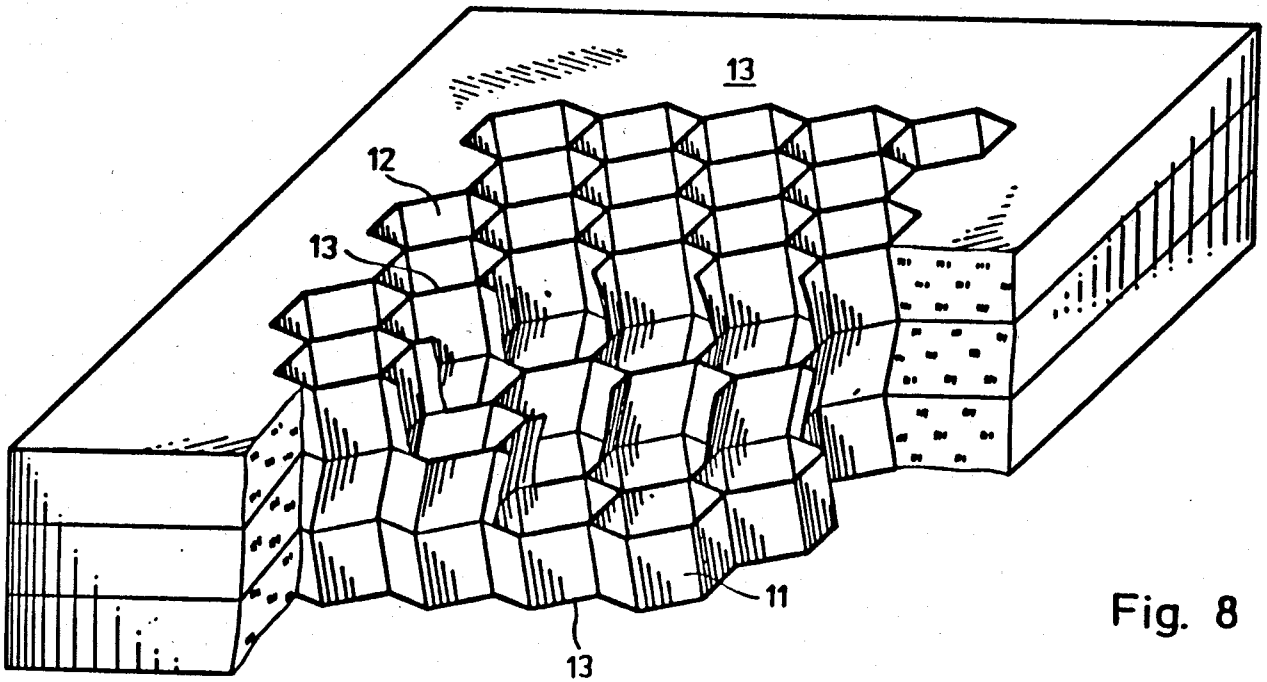
FIG. 8 is a schematic perspective view of the structure of a stack of multichannel plates according to the invention.

FIG. 8 shows part of a stack of plates produced according to the invention. The glass structure 11 of each plate defines an array of parallel channels 12 whose axes are oblique to the plate surfaces. The plates are arranged so that the channel axes of one plate are inclined in the opposite direction from the channel axes of the immediately adjacent plates. Thus, the resulting stack presents a plurality of channels 12 which each follow a zigzag path between the upper and lower surfaces 13 of the stack. At the same time, at each interface between two plates, the walls of the associated portions of each channel are mutually aligned.

For fabricating the multichannel positive mold, a 0.5 mm thick PMMA layer was generated by coating the iron-nickel base plate with Plexit 74, which is a mold material produced by Röhm GmbH, Darmstadt, F.R.G. The X-ray mask was composed of a titanium foil and the absorber was generated by electrodeposition of gold. The integral dosage in the irradiated parts of the PMMA layer was approximately 1000 J/cm$^3$. The irradiated parts of the PMMA layer were removed by means of a developer solution consisting of 20% tetrahydro-1,4-oxazine, 5% monoethanol amine, 10% water and 65% diethylene-glycol-monobutyl-ether at a temperature of 35° C. The electrodeposition of the iron nickel alloy was carried out in a plating bath with iron chloride, nickel chloride and citric acid. The positive mold consists of cross-linked PMMA, it is first irradiated by highly energetic electrons and then dissolved by means of dichloromethane. The metallic negative mold was filled with lead glass in a vacuum vessel. Then the structure was annealed over a period of four hours.

For fabricating the secondary positive mold, also Plexit 74 was used as a mold material. Besides a silicon-based external separating agent, an internal separating agent (type PAT 665, produced by Würtz GmbH, Bingen, F.R.G.) was used, in order to facilitate the mechanical separation of the secondary positive mold from the primary negative mold. The further steps of the fabricating process of the microchannel plate were identical to those described above.

It will be understood that the above description on the present invention is susceptible to various modifications, changes and adaptations, and the same are intended to be comprehended within the meaning and range of equivalents of the appended claims.

What is claimed is:

1. A method for producing a multichannel plate containing a plurality of generally parallel channels for use in structures for amplifying or converting optical images or other two-dimensional signal patterns by secondary electron multiplication, said method comprising:

(a) producing a positive mold of the plate, by the steps of:

(i) providing a body having the external shape of the plate to be produced and made of a material whose ability to be removed from the body is altered by exposure to a selected radiation;

(ii) irradiating the body with the selected radiation in a pattern corresponding to the plate to be produced and in a manner to render the portions of the body corresponding to the channels more easily removable than the remaining portions of the body; and (iii) removing the more easily removable portions of the body;

(b) forming a metal negative mold, by the steps of:
(i) attaching the positive mold to a metal electrode;
(ii) electrolytically depositing metal on the electrode and in the openings created in the positive mold by said step of removing more easily removable portions; and
(iii) removing the positive mold from the deposited metal; and
(c) forming the multichannel plate from the negative mold.

2. A method as defined in claim 1, wherein said step of forming the multichannel plate comprises the steps of:
forming a secondary multichannel positive mold from the negative mold;
mounting the secondary positive mold on a second electrode;
electrolytically depositing metal on the second electrode and in the openings in the secondary positive mold;
removing the secondary positive mold from the deposited metal so that the deposited metal constitutes a secondary negative mold;
filling the secondary negative mold with a material suitable for forming the multichannel plate; and
removing the secondary negative mold from the material.

3. Method as defined in claim 2 wherein said steps of filling and removing the negative mold are carried out several times to produce several secondary multichannel positive molds, and said steps of mounting, electrolytically depositing on the second electrode, removing the secondary positive mold, filling the secondary negative mold, and removing the secondary negative mold are performed for each secondary positive mold.

4. A method as defined in claim 1 wherein the plate has opposed, parallel major faces between which the channels extend, and the axes of the channels are oblique to the major faces.

5. A structure comprising a plurality of multichannel plates each produced according to the method defined in claim 4, said plates being stacked so that said channels in one said plate are in alignment with said channels in plates adjacent said one plate, and said plates being oriented relative to one another so that the axes of said channels in one said plate are inclined in the opposite direction from the axes of said channels of the immediately adjacent plates, whereby said plurality of plates present a plurality of channels which each follow a zigzag path.

6. A method for producing a structure, said method comprising: producing a plurality of multichannel plates, each according to the method defined in claim 4; and stacking said plates so that said channels in one of said plates are in alignment with said channels in plates adjacent said one of said plates, and orienting said plates relative to one another so that the axes of said channels in said one of said plates are inclined in the opposite direction from the axes of said channels of the immediately adjacent plates, whereby said plurality of plates present a plurality of channels which each follow a zigzag path.

* * * * *